United States Patent [19]

Cowan

[11] Patent Number: 4,510,890

[45] Date of Patent: Apr. 16, 1985

[54] INFRARED WATER HEATER

[76] Inventor: Edwin J. Cowan, 22 Swift Ct., Newport Beach, Calif. 92663

[21] Appl. No.: 484,097

[22] Filed: Apr. 11, 1983

[51] Int. Cl.[3] ..... F22B 5/00

[52] U.S. Cl. ..... 122/17; 122/44 A; 122/155 R; 122/367 R; 126/350 R; 126/361; 431/328

[58] Field of Search ..... 122/13 R, 14, 16, 17, 122/19, 44 A, 23, 33, 155 R, 367 R; 126/350 R, 361; 431/326, 328, 329

[56] References Cited

U.S. PATENT DOCUMENTS

| | | | |
|---|---|---|---|
| 2,698,007 | 12/1954 | Tegler | 122/13 R |
| 3,492,972 | 2/1970 | McLaren | 122/17 |
| 3,653,796 | 4/1972 | Kercher et al. | 431/328 |
| 3,832,122 | 8/1974 | LaHaye et al. | 431/326 |
| 3,897,198 | 7/1975 | Longworth | 431/328 |

FOREIGN PATENT DOCUMENTS

| | | | |
|---|---|---|---|
| 2041181 | 9/1980 | United Kingdom | 122/367 R |

*Primary Examiner*—Edward G. Favors
*Assistant Examiner*—Steven E. Warner
*Attorney, Agent, or Firm*—Warren T. Jessup

[57] ABSTRACT

A fluid heater consists of a water tank, to the side of which is mounted an infrared burner which radiates heat at very high temperature, horizontally, against the side wall of the tank. Burned gases are conducted upward in heat conducting relation with the water in the tank and are then vented.

3 Claims, 8 Drawing Figures

INFRARED WATER HEATER

BACKGROUND

The typical domestic water heater utilizes a central flue which is normally 3 to 4 inches in diameter depending, upon the burner input. The flue is normally 2 to 4 feet in length and connected at the bottom to an upward convex tank bottom or header. A circular burner is placed a few inches below the bottom. Gases from the burner are burned within the confines of the interior of the tank below the bottom, and flow up the central flue. A baffle is normally placed in the flue to maximize heat transfer between the hot gases and the sidewalls of the flue and thence into the water in the tank. The flue and bottom are uninsulated, because they are the prime heat exchange surfaces to conduct heat into the water. Efficiency of heat transfer from gases to surfaces is typically required to be at least 70%. A pilot is used to ignite the burner. Burnt gases from the pilot flow up the flue and retard heat loss from the exposed uninsulated surfaces of the flue and bottom. The baffling in the flue must be adjusted for the full firing rate of the burner when operating, to provide maximum efficiency with complete combustion of the flue gases. When the burner is not on, the pilot gases flowing up the flue are under baffled, because the pilot flow rate is only about 1 to 5% of that of the main burner. The exposed flue and heater bottom are cooled when the main burner is off, causing a loss of heat from the water inside the tank. This standby loss of heat must be replaced to maintain water temperature.

With the shortage of natural gas (methane) worldwide, and increasing costs, efforts have been taken in recent years to increase efficiency by adding insulation, and by minimizing flow of excess air going up the flue. In addition, there has been growing concern regarding air pollution caused by oxides of nitrogen (NOX) generated in the burner flames of a conventional water heater.

One Government agency has estimated that 12 tons of NOX issue daily from the 3,000,000 odd water heaters in the area served. The agency has called for a 50% reduction in such emissions; and is requiring that no water heater sold may have NOX emission of more than 40 nanograms per joule of heat generated. It is difficult and costly to attain such reduction with conventional burners, which normally operate with secondary air.

SUMMARY OF THE INVENTION

In the present invention the water tank is heated by an infrared burner applied to the side of the tank. A gas infrared burner operates much differently from that of a conventional or secondary aerated Bunsen type burner. A conventional gas burner normally operates with injection of primary air constituting only about 25–50% of the total air required to complete combustion. The balance of the combusion air, generally referred to as secondary air, completes the combustion by entering the burner flames and oxidizing the remainder of the gases as they are burning. The infrared burner injects, as primary air, over 100% of the air required for combustion and requires no secondary air to complete combustion at the burner nozzle or ports. Further, the infrared burner generally burns with extremely short flames, not over ⅛ inch in height. The short flames conduct heat back to ceramic grids, which are typically used as the burning surface, causing the surface to attain a temperature of 1500–1700 degrees F. The infrared burner transfers by radiation more than 50% of the heat energy of the burning gases. It needs very little excess air to burn completely, resulting in higher convection efficiency when the burnt gases are confined to a heat transferring flue or other heat exchange chamber. Another advantage of the infrared burner is its ability to burn properly in various attitudes, because it is not dependent on secondary air to complete combustion. A conventional burner is generally limited to being positioned horizontally beneath the tank or other heat transfer surface. Also, the noise level of the infrared burner is much less than that of the secondary aerated burner.

Test results have shown that approximately 90% less oxides of nitrogen are generated than in conventional water heaters. The present design is not costly, and produces good efficiency, and low standby loss when the infrared burner is not firing. This is accomplished by greatly limiting the amount of cold air that siphons up the flue when the burner is not operating.

Abandoned experiments have been made replacing the conventional burner at the bottom of the tank with an infrared burner. This, however, continues many of the old disadvantages. As water is heated in the tank, salts would precipitate out, and lime would build up on the bottom. This in effect would insulate the water from receiving heat from the subjacent burner, and greatly reduce efficiency. Also, condensate gathering in the flue and on the underside of the tank bottom would drop down onto the burner with resulting contamination. In another effort, a special tubular infrared burner was installed in the central flue. Such placement, however, rendered the burner very inaccessible for maintenance and even required a special, radial viewing tube to observe burner performance.

The side wall mounting of the present invention allows use of the external surface of the heater sidewall for heat transfer. The heat transfer surface is constituted by the arcuate portion of the tank sidewall facing the burner and by a flue, which may be centrally located or peripheral, as desired. Liming at the bottom caused by salt precipitation has negligible effect on heat transfer, because the side mounting is sufficiently above the bottom of the tank to clear any such insulative build up. The overall height of the heater is reduced, for a given tank capacity, because of the elimination of the burner compartment beneath the tank.

THE FIGURES

A preferred embodiment of the invention will now be described.

THE FIRST EMBODIMENT

Figure 1:
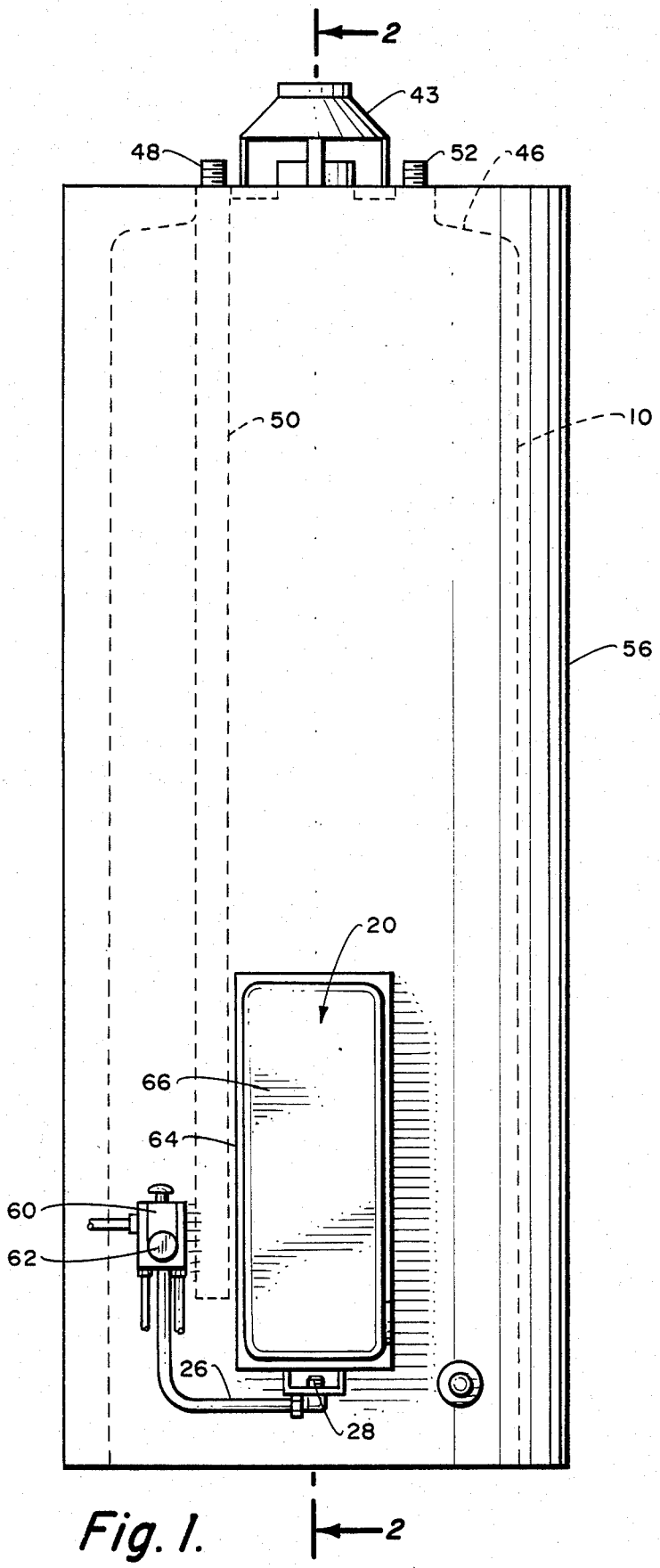
FIG. 1 is a front elevation of the fluid heater, shown in the form of a typical residential water heater.
Figure 2:
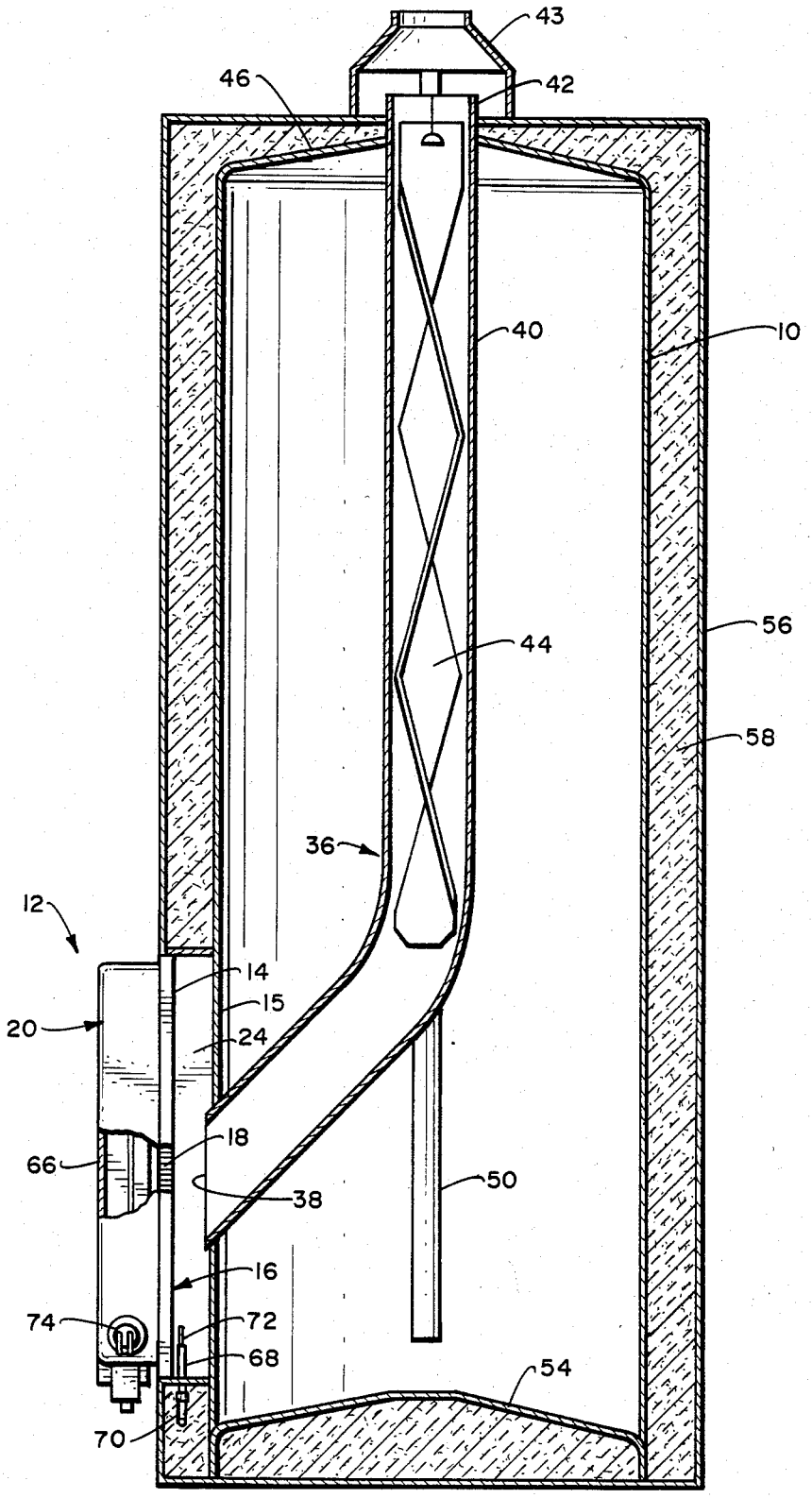
FIG. 2 is a side elevational section taken generally on the line 2—2 in FIG. 1.
Figure 3:
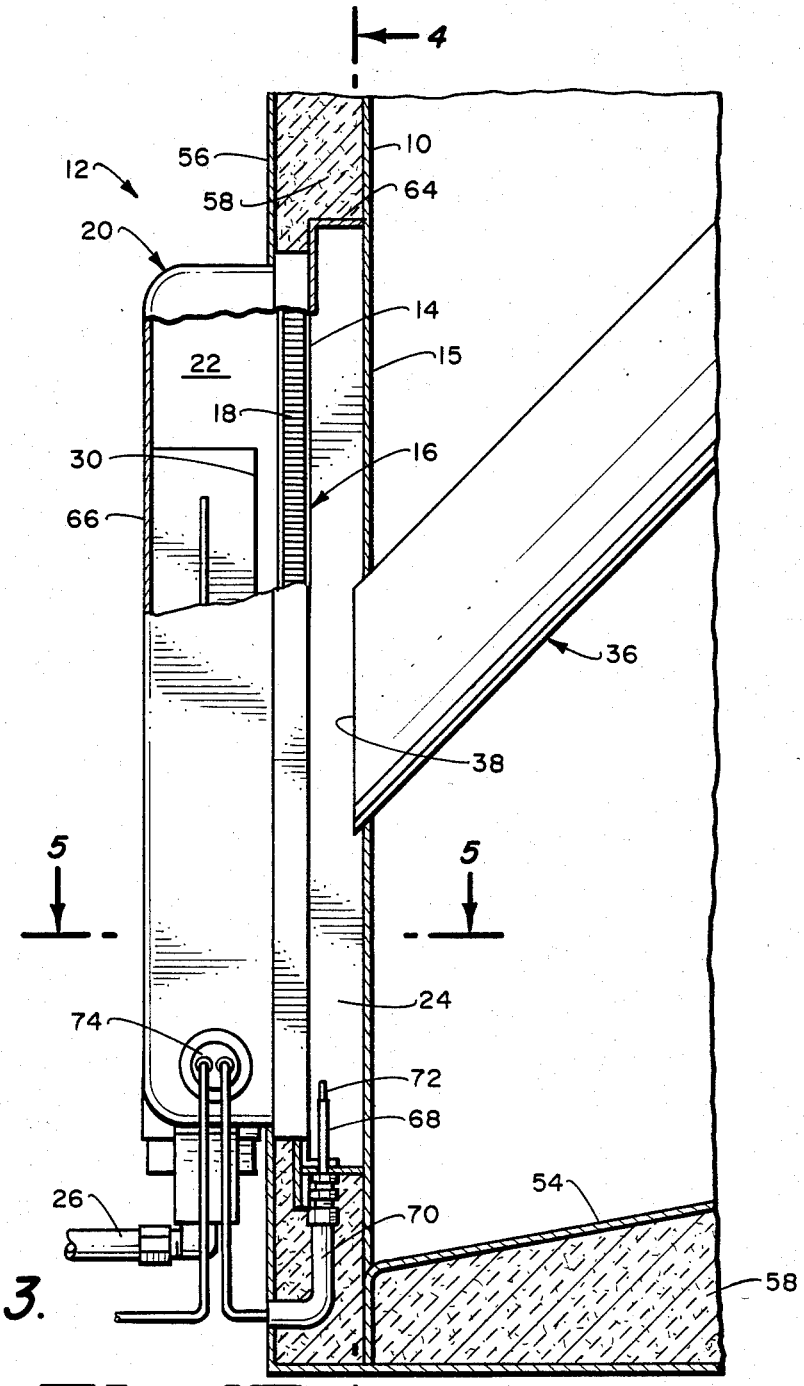
FIG. 3 is an enlarged, fragmentary view of the lower portion of FIG. 2.
Figure 6:
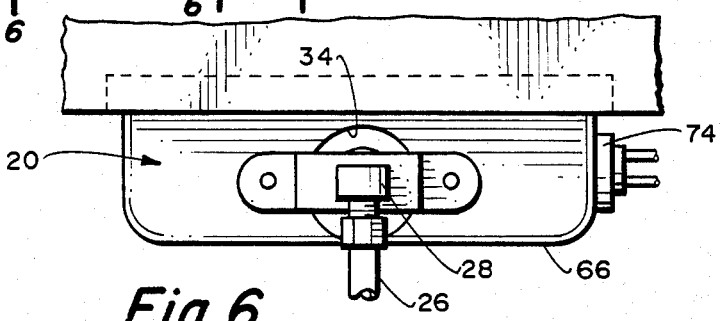
FIG. 6 is a view taken on line 6—6 in FIG. 3.

In the figures, 10 is a vertical, upright metal cylindrical tank adapted to contain the fluid to be heated, in this case, water, such as in a household water heater. A flat, rectangular infrared burner 12 is mounted near the lower end of the tank 10. The burner 12 has a radiating surface 14 facing the tank. Heat from the surface 14 radiates to the adjacent metal wall 15 of the tank 10 and heats the water therein. The surface 14 forms one face of a gas-permeable panel 16. In the embodiment shown such permeability is effected by perforations 18 forming burner ports therein.

The panel 16 divides the interior of a housing 20 into two chambers 22 and 24. Chamber 22 constitutes a mixing chamber where burnable gas, such as methane, is mixed with primary air before being ignited and burned in chamber 24, which constitutes a combustion chamber. The air/gas mixture passes from chamber 22 through perforations 18 in panel 16 into chamber 24, where it is ignited and burns, bringing the surface 14 to very high temperature, in the order of 1500–1700 degrees F. Heat radiates from the surface 14 across the chamber 24 to the adjacent wall 15 of the tank 10 and thence into the water in the tank. Sensible heat is also conducted through wall 15 into the tank water.

The gas to fire the heater comes from an input pipe 26 which feeds an orifice or nozzle 28 located beneath the chamber 22, and which directs the gas upwardly into a vertical tube 30 having a venturi restriction 32. A circular opening 34 in the floor of the housing 20 through which gas from nozzle 28 passes also allows ambient primary air to be drawn into the venturi 32. The air/gas mixture passes upward in the tube 30 and exits into the chamber 22 where further mixing takes place. It is then forced thru the perforations 18 into the combustion chamber 24, as noted above.

Further heat is imparted to the water in the tank 10 as combustion products are discharged from the combustion chamber 24. This is effected by a tubular flue 36, the lower end 38 of which passes through the tank wall 15 and communicates with the chamber 24. Tube 36 extends generally radially upward into the interior of the tank 10 and then goes vertically up along the tank axis, as shown at 40, to exit at the flue outlet 42 at the top of the tank. Above the outlet 42 is a draft hood 43. Within the portion 40 of the flue 36 is a spiral baffle 44, which causes the gases to swirl and enhance heat transfer to the water around the portion 40.

In the top head 46 of tank 10 is a water inlet 48 connected to a plastic dip tube 50 within the tank; and a water outlet 52. A bottom 54 completes the tank enclosure. A casing 56 surrounds the tank 10; the space between is filled with insulation 58. Mounted against the outside of tank 10 is an automatic temperature control and gas pressure control 60 through which gas passes before it reaches the orifice or nozzle 28. The gas is turned off and on in accordance with water temperature in tank 10, and in dependence upon a setting applied manually through knob 62.

Figure 4:
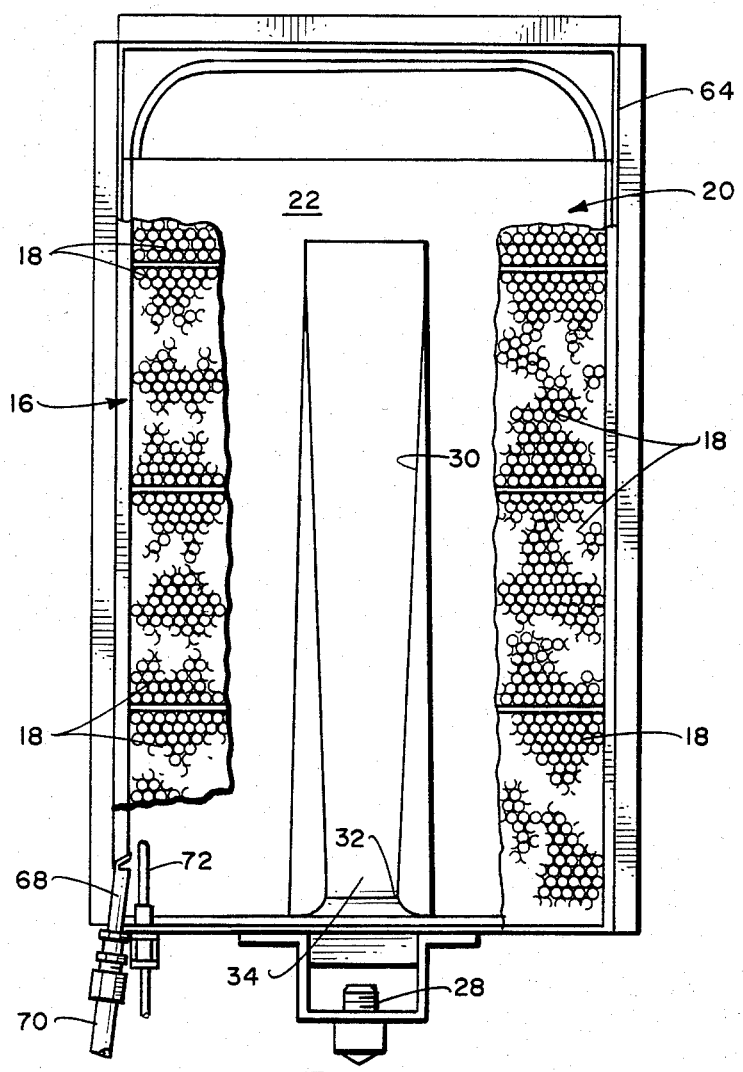
FIG. 4 is a view taken on line 4—4 in FIG. 3.

The housing 20 comprises a rectangular frame 64 secured to the outside of the lower wall portion 15 of the tank 10. The perforated panel 16 closes off the frame 64 and forms the combustion chamber 24. A shell 66 overlies the panel 16 and forms the mixing chamber 22. The panel 16 may be formed of a series of ceramic grids, as seen in FIG. 4. Adjacent the bottom of the panel 16 and within the chamber 24 is a pilot 68 supplied with gas by a pipe 70. A thermocouple 72 adjacent the pilot 68 senses the presence or absence of pilot flame. A heat limiting sensor 74 contacts the shell 66 to sense excessive temperature therein such as might occur if the grids of panel 16 crack and allow flame to flash back into the mixing chamber. Sensor 74 and thermocouple 72 are connected in series and to control 60, to shut off gas in the event of either flash back or pilot outage.

Figure 5:
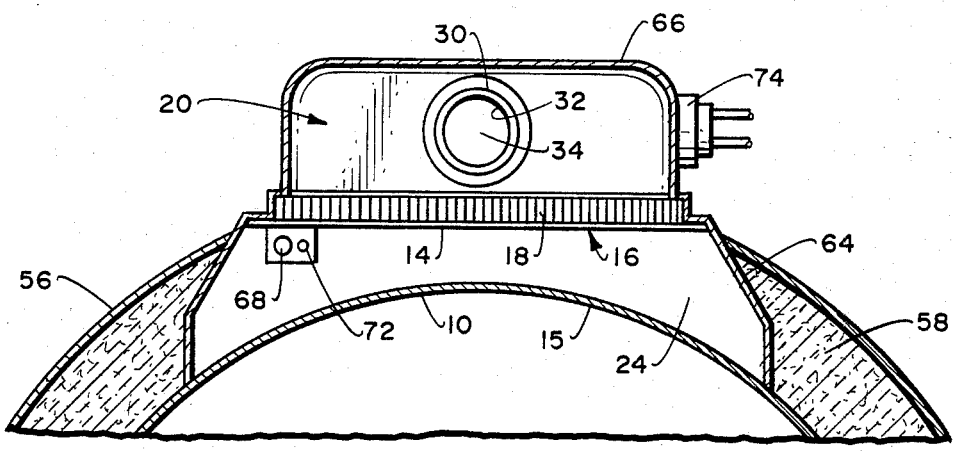
FIG. 5 is a section taken on line 5—5 in FIG. 3.

The spacing between the radiating surface 16 and the closest point on the tank wall 15 (FIG. 5) is not critical and as a practical matter may vary from about ¼ to 4 inches. In the embodiment shown, the actual spacing is about 1 inch. By admitting only primary air, and that through the restricted venturi 32, the heat loss up the flue during standby is greatly reduced. In the embodiment shown, the cross sectional area of the venturi 32 is only about 15% of that of the flue 36, and may be as small as 10%. Approximately 50% of the heat discharged from the hot surface 14 enters the water in tank 10 by radiation across the chamber 24. The rest of the heat passes by conduction thru the wall of the flue 36, or is vented out the stack.

The pilot 68 is shown as a conventional Bunsen burner which does require secondary air, but the opening therefor may be so small as to have but negligible effect on the overall operation of the heater. If desired, an infrared type of pilot, which requires no secondary air, as disclosed in U.S. Pat. No. 3,395,693, may be employed.

ALTERNATIVE EMBODIMENTS

In the first embodiment above, a flat infrared burner has been employed, because such burners are readily available, having been employed in space heating for some time. If desired, however, the infrared burner made be made arcuate and extend around a larger portion of the tank and still maintain satisfactory (in this case uniform) spacing from the tank wall.

While in the first embodiment there was disclosed specifically a tubular flue which extends directly from the combustion chamber into the interior of the tank and thence upward, the burnt gases may, if desired, be maintained around the exterior of the tank and directed into a peripheral, cylindrical annulus surrounding all or a portion of the tank. As in the case shown above, heat will continue to be transferred to the water as the gases flow upward to the stack.

Figure 7:
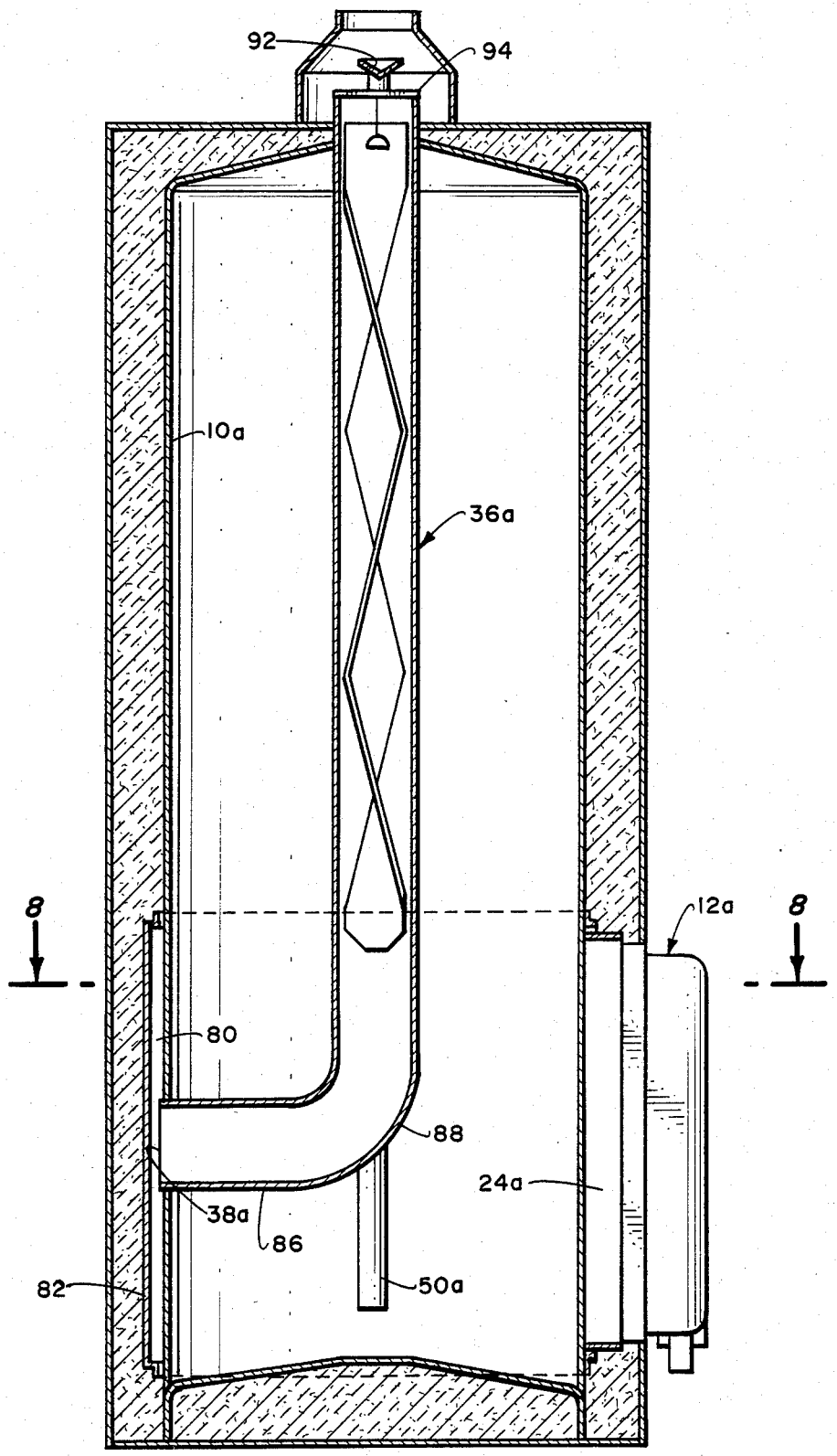
FIG. 7 is a side elevational section generally similar to FIG. 2, of another embodiment of the present invention.
Figure 8:
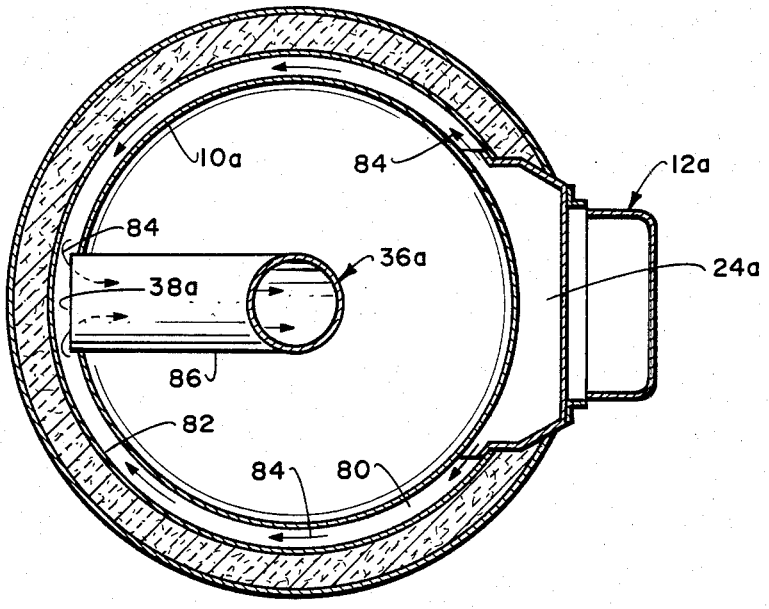
FIG. 8 is a cross-section taken on line 8—8 in FIG. 7.

The cylindrical heat exchange annulus need not extend up the entire height of the water tank. In FIGS. 7 and 8 is shown an alternative structure wherein the annular heat exchange chamber extends entirely around the water tank, but is limited to the lower portion of the tank, so that higher heat transfer efficiency between the hot gas and the cold water is attained.

In these figures, portions of the water heater corresponding or substantially identical to those shown in the first embodiment carry the same reference numerals with the suffix "a". The infrared burner **12*a* is located on the opposite side of the tank 10*a* from the intake, lower end 38*a* of the flue 36*a*. The hot gases flow from the combustion chamber 24*a* around the circumference of the tank 10*a* in an annular chamber 80 formed between the wall of the tank 10*a* and a relatively thin cylinder 82 forming the outer circumference of the annular chamber 80. The flow of gas from the combustion chamber 24*a* is shown in FIG. 8 by the flow arrows 84. The gas flows in both directions, circumferentially around the tank 10***a* in the annulus 80 to the entrance 38*a* of the flue 36*a*.

This embodiment also illustrates that the flow of the hot gas through the flue 36*a* may be directly radially inward, substantially perpendicular to the tank axis, as shown at 86, and thence turn upward at 90 degrees, as shown at 88, to exit axially out the upper end of the heater, as in the first embodiment.

FIG. 7 also illustrates a downdraft deflector cone 92 at the outlet of flue 36*a* to deflect external downdraft away from the flue 36*a*. Cone 92 is held in position by a spider at the top of flue 36*a*, two legs of which are seen at 94.

What is claimed is:

1. Fluid heater comprising:

a tank adapted to hold fluid to be heated;

an infrared burner mounted at the side of said tank and comprising:

a housing having a permeable, vertical, interior panel dividing the interior of said housing into a combustion chamber means and a mixing chamber means, said combustion chamber means being between said panel and said tank, the face of said panel contiguous to said combustion chamber means constituting a radiating surface facing said tank, burnable gas input means communicating with said mixing chamber means, for supplying burnable gas to said burner, air input means for admitting primary ambient air to said mixing chamber means, whereby gas and air pass from said mixing chamber means into said combustion chamber means, and are ignited and burn therein, thereby heating said radiating surface;

flue means communicating at one end with said combustion chamber means, thence extending upward in heat exchange relation with fluid in said tank, and exiting at the top of said tank.

2. Fluid heater comprising:

a vertical, cylindrical tank adapted to hold fluid to be heated;

an infrared burner mounted at the side of said tank and comprising:

a housing having a gas-permeable, vertical, interior panel dividing the interior of said housing into a combustion chamber means and a mixing chamber means, said combustion chamber means being between said panel and said tank, the face of said panel contiguous to said combustion chamber means constituting a radiating surface facing said tank, burnable gas input means communicating with said mixing chamber means, for supplying burnable gas to said burner, air input means for admitting primary ambient air to said mixing chamber means, whereby gas and air pass from said mixing chamber means into said combustion chamber means, and are ignited and burn therein, thereby heating said radiating surface;

flue means communicating at one end with said combustion chamber means, thence extending generally radially into the center of said tank, and upward along the axis of said tank, in heat exchange relation with fluid in said tank, and exiting at the top of said tank.

3. Fluid heater comprising:

a vertical cylindrical tank adapted to hold fluid to be heated;

an infrared burner mounted at the side of said tank and comprising a housing having a vertical, interior panel dividing the interior of said housing into two chamber means, one of said chamber means constituting said combustion chamber means, the other constituting mixing chamber means, the face of said panel contiguous to said combustion chamber means facing said tank and constituting said radiating surface, said panel being gas-permeable to permit gas to flow to said surface;

burnable gas input means communicating with said mixing chamber for supplying burnable gas to heat said surface;

and including air input means for admitting primary ambient air to said mixing chamber means;

flue means communicating at one end with said chamber means and extending generally radially into the center of said tank, thence extending upward along the axis of said tank, and in heat exchange relation with fluid in said tank, and exiting at the top of said tank;

the permeability of said panel permitting flow between said two chamber means;

whereby gas and air pass from said mixing chamber means into said combustion chamber means, and are ignited and burn therein;

thereby heating said radiating surface.

* * * * *